US009768520B2

(12) United States Patent
Parsche

(10) Patent No.: US 9,768,520 B2
(45) Date of Patent: Sep. 19, 2017

(54) BROADBAND DUAL POLARIZATION OMNI-DIRECTIONAL ANTENNA AND ASSOCIATED METHODS

(71) Applicant: Harris Corporation, Melbourne, FL (US)

(72) Inventor: Francis Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 628 days.

(21) Appl. No.: 13/963,148

(22) Filed: Aug. 9, 2013

(65) Prior Publication Data

US 2015/0303588 A1 Oct. 22, 2015

(51) Int. Cl.

| | |
|---|---|
| ***H01Q 21/24*** | (2006.01) |
| ***H01Q 13/04*** | (2006.01) |
| ***H01Q 9/28*** | (2006.01) |
| ***H01Q 9/40*** | (2006.01) |

(52) U.S. Cl.

CPC ..... *H01Q 21/245* (2013.01); *H01Q 9/28* (2013.01); *H01Q 9/40* (2013.01); *H01Q 13/04* (2013.01)

(58) Field of Classification Search

CPC ..... H01Q 21/245; H01Q 13/04; H01Q 9/28; H01Q 9/40

USPC ..... 343/846, 790, 773, 774, 775, 725, 727, 343/729, 730, 767

See application file for complete search history.

(56) References Cited

U.S. PATENT DOCUMENTS

| | | | | |
|---|---|---|---|---|
| 2,368,663 | A * | 2/1945 | Kandoian | H01Q 1/282 343/705 |
| 3,618,107 | A * | 11/1971 | Spanos | H01Q 9/28 343/773 |
| 3,942,180 | A * | 3/1976 | Rannou | H01Q 19/06 343/725 |
| 4,410,893 | A * | 10/1983 | Griffee | H01Q 21/10 343/792 |
| 4,814,777 | A | 3/1989 | Monser | |
| 5,068,671 | A * | 11/1991 | Wicks | H01Q 13/085 343/799 |
| 6,154,182 | A * | 11/2000 | McLean | H01Q 9/28 343/752 |
| 6,380,906 | B1 | 4/2002 | Cesulka | |
| 7,006,047 | B2 | 2/2006 | Marsan et al. | |
| 7,116,278 | B2 | 10/2006 | Marsan et al. | |
| 7,453,414 | B2 | 11/2008 | Parsche | |

(Continued)

OTHER PUBLICATIONS

Ghosh et al.; Design of a Wide-Angle Biconical Antenna for Wideband Communications; Progress in Electromagnetics Research B, vol. 16, p. 229-245, 2009.*

(Continued)

*Primary Examiner* — Dameon E Levi
*Assistant Examiner* — Ab Salam Alkassim, Jr.
(74) *Attorney, Agent, or Firm* — Allen, Dyer, Doppelt + Gilchrist, P.A. Attorneys at Law

(57) ABSTRACT

An antenna includes a conductive antenna body having first and second opposing ends with an enlarged width medial portion therebetween. A slot extends from at least adjacent the first end to at least adjacent the second end, and first antenna feed points are adjacent the slot for a first polarization. A conductive antenna member is adjacent the second end of the conductive antenna body and has a planar shape and a second antenna feed point for a second polarization.

21 Claims, 12 Drawing Sheets

(56) References Cited

U.S. PATENT DOCUMENTS

| | | | | |
|---|---|---|---|---|
| 7,808,441 | B2 | 10/2010 | Parsche et al. | |
| 7,965,252 | B2 | 6/2011 | Shtrom et al. | |
| 8,228,257 | B2 | 7/2012 | Lalezari | |
| 2004/0183736 | A1* | 9/2004 | Sato | H01Q 1/243 343/725 |
| 2005/0122274 | A1* | 6/2005 | Marsan | H01Q 1/28 343/773 |
| 2006/0187134 | A1* | 8/2006 | Hoshi | H01Q 9/40 343/773 |
| 2007/0159408 | A1* | 7/2007 | Parsche | H01Q 5/50 343/866 |
| 2009/0289866 | A1* | 11/2009 | Parsche | H01Q 9/28 343/790 |
| 2010/0066627 | A1* | 3/2010 | Parsche | H01Q 7/00 343/795 |
| 2011/0273345 | A1* | 11/2011 | Kuramoto | H01Q 1/273 343/718 |
| 2011/0298679 | A1* | 12/2011 | Elliot | H01Q 9/28 343/727 |
| 2012/0068903 | A1* | 3/2012 | Thevenard | H01Q 3/247 343/795 |
| 2013/0127686 | A1* | 5/2013 | Fruh | H01Q 1/18 343/887 |
| 2014/0035786 | A1* | 2/2014 | Ley | H01Q 9/0407 343/700 MS |

OTHER PUBLICATIONS

U.S. Appl. No. 13/963,182, filed Aug. 9, 2013.

* cited by examiner

BROADBAND DUAL POLARIZATION OMNI-DIRECTIONAL ANTENNA AND ASSOCIATED METHODS

FIELD OF THE INVENTION

The present invention relates to the field of antennas, and more particularly, to a biconical antenna and related methods.

BACKGROUND OF THE INVENTION

Conical antennas, which include a single inverted cone over a ground plane, and biconical antennas, which include a pair of cones oriented with their apexes pointing toward each other, are used as broadband antennas for various applications.

Excitation of biconical dipoles is accomplished by imparting an electrical potential across the apex of the two opposing cones, causing a TEM mode. This mode is analogous to the $T_{E01}$ mode of sectoral horns, but as the biconical dipole is a complete figure of revolution, symmetric about the cone axis, the TEM mode results. In a biconical dipole, excitation is by the dipole moment formed across the horn walls (opposing cones), so the structure is self exciting. A biconical dipole antenna is an example of an omni-directional vertically polarized antenna of relatively great bandwidth.

$TE_{10}$ modeling of conventional biconical dipole structures has been proposed for the purpose of horizontal polarization and omni-directional radiation. In one instance, a circle of wire operates as a loop antenna and an excitation probe, and is placed normal to the bicone axis. For example, U.S. Pat. No. 7,453,414 discloses a biconical loop antenna that is the dual to the biconical dipole antenna, and has broadband omni-directional horizontally polarized radiation. This patent is assigned to the current assignee of the present invention, and is incorporated herein by reference in its entirety.

The cone is an example of an Euclidian geometry. Euclidian geometries often provide excellent antenna shapes. In terms of geometry, a cone is a solid figure bounded by a plane base and a surface called the lateral surface formed by the locus of all straight line segments joining the apex to the perimeter of the base. The first instance of a cone as an antenna may be unknown, but the textbook "Antennas", $2^{nd}$ edition, by John Kraus, W8JK, states that Sir Oliver Lodge constructed a biconical dipole antenna by 1897.

Even in view of the advances made in biconical antennas, there is still a need for such an antenna that supports both vertical polarization and horizontal polarization.

SUMMARY OF THE INVENTION

In view of the foregoing background, it is therefore an object of the present invention to provide a broadband omni-directional biconical antenna that is dual polarized.

This and other objects, features, and advantages in accordance with the present invention are provided by an antenna comprising a conductive antenna body and an adjacent conductive antenna member. The conductive antenna body has first and second opposing ends with an enlarged width medial portion therebetween. A slot extends from at least adjacent the first end to at least adjacent the second end. First antenna feed points are adjacent the slot for a first polarization. The conductive antenna member has a planar shape and a second antenna feed point for a second polarization.

The first polarization associated with the conductive antenna body may correspond to horizontal polarization.

The second polarization associated with the conductive antenna member may correspond to vertical polarization which is orthogonal to the horizontal polarization. The conductive antenna body may be configured as a biconical omni-directional antenna with the horizontal polarization with the conductive antenna member advantageously providing the vertical polarization. Collectively, the conductive antenna body and the conductive antenna member may provide a dual polarized omni-directional antenna that advantageously operates over a wide band of frequencies.

The conductive antenna body may comprise first and second conical antenna elements coupled together at the medial portion. The conductive antenna member may be configured as a conductive antenna disk. The medial portion of the conductive antenna body may be aligned with a periphery of the conductive antenna disk.

A first coaxial cable may have inner and outer conductors coupled to respective ones of the first antenna feed points. A second coaxial cable may extend through the first and second conical antenna elements, and has an inner conductor coupled to conductive antenna member and an outer conductor coupled to at least the second conical antenna element.

The conductive antenna body and/or the conductive antenna member may comprise a continuous conductive layer. Alternatively, the conductive antenna body and/or the conductive antenna member may comprise a wire structure.

Another aspect is directed to a method for making an antenna comprising forming a conductive antenna body having first and second opposing ends with an enlarged width medial portion therebetween. A slot may extend from at least adjacent the first end to at least adjacent the second end. First antenna feed points may be adjacent the slot for a first polarization. A conductive antenna member having a planar shape and a second antenna feed point for a second polarization may be formed. The conductive antenna member may be positioned adjacent the second end of the conductive antenna body.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
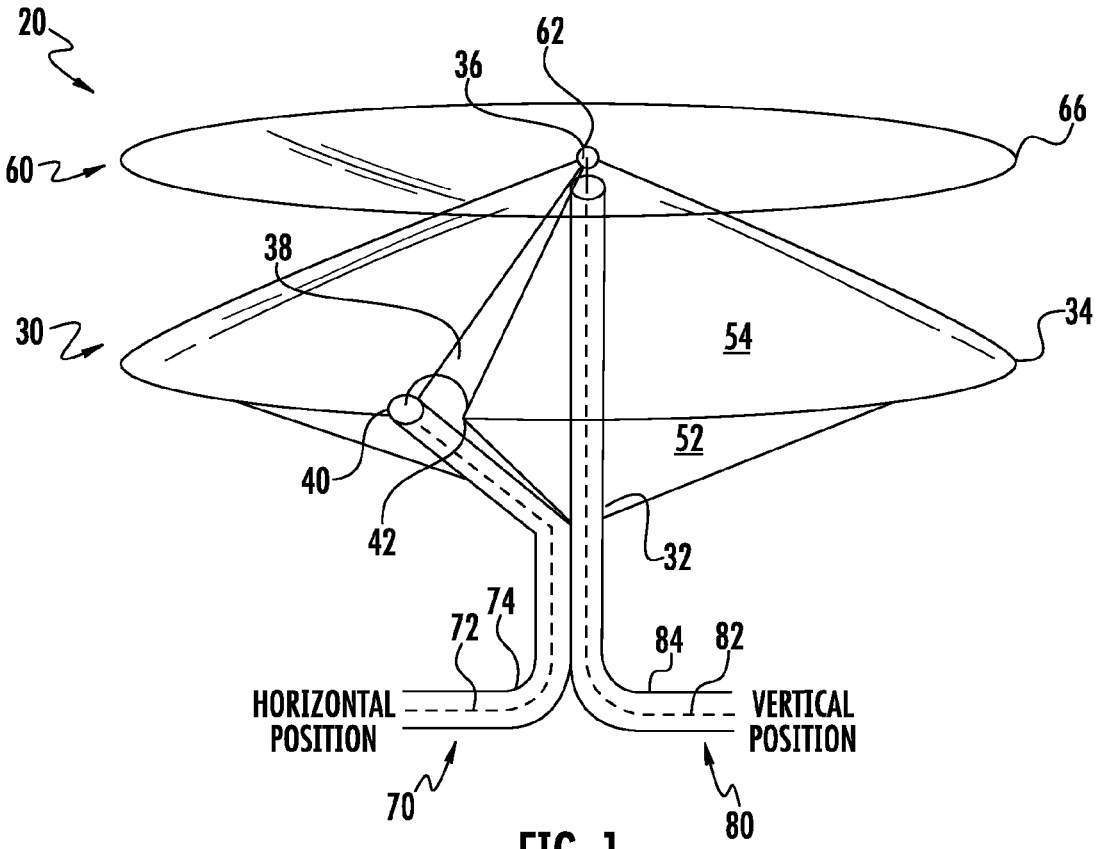
FIG. 1 is a side perspective view of an antenna in accordance with the present invention with continuous conductive layers.

Referring initially to FIG. 1, an antenna 20 includes a conductive antenna body 30 and a conductive antenna member 60 adjacent the conductive antenna body. The conductive antenna body 30 has first and second opposing ends 32, 36 with an enlarged width medial portion 34 therebetween. One or more slots 38 extend from at least adjacent the first end 32 to at least adjacent the second end 36. First antenna feed points 40, 42 are adjacent the slot 38 for a first polarization. The conductive antenna member 60 has a planar shape and a second antenna feed point 62 for a second polarization.

The antenna 20 may be mounted such that the first polarization associated with the conductive antenna body 30 corresponds to horizontal polarization and the second polarization associated with the conductive antenna member 60 corresponds to vertical polarization. The conductive antenna body 30 is configured as a biconical omni-directional antenna with the horizontal polarization while the conductive antenna member 60 advantageously provides the vertical polarization. Of course, other mounting arrangements of the antenna 20 will change the polarization, but in general they will be orthogonal to one another. Collectively, the conductive antenna body 30 and the conductive antenna member 60 provide a dual polarized omni-directional antenna 20 that advantageously operates over a wide band of frequencies. As background, polarization refers to the orientation of radio wave electric fields. For horizontal polarization the E fields are parallel to the earth's surface, and for vertical polarization the E fields are normal to the earth's surface.

The conductive antenna body 30 illustratively includes first and second conical antenna elements 52, 54 coupled together at the medial portion 34. The medial portion 34 is also referred to as the rim or chine of the conductive antenna body 30. The conductive antenna member 60 is configured as a conductive antenna disk. The medial portion 34 of the conductive antenna body 30 is illustratively aligned with a periphery 66 of the conductive antenna disk 60.

The conductive antenna body 30 and the conductive antenna member 60 may be hollow or solid. In the illustrated embodiment of the solid configuration for the conductive antenna body 30, the slot 38 extends from a central axis of the conductive antenna body 30 to an exterior surface thereof. The conductive antenna member 60 carries a radially expanding and contracting RF current distribution for vertical polarization excitation, and may be thought of as a radial dipole form of the annular slot. The conductive antenna member 60 may be a rather modest size diameter relative to a diameter of the conductive antenna body 30 with useful results.

Figure 2:
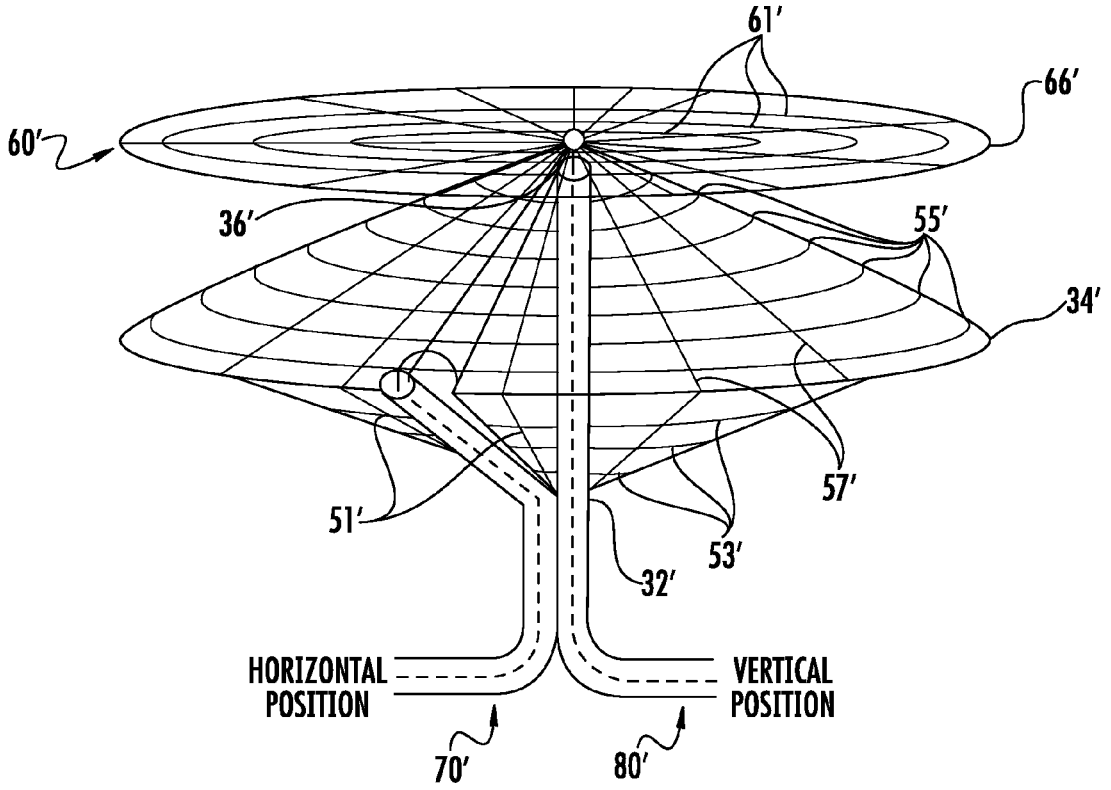
FIG. 2 is a side perspective view of another embodiment of the antenna illustrated in FIG. 1 with wire structures.

The conductive antenna body 30 and the conductive antenna member 60 may be made from a continuous conductive layer, such as brass sheet metal, for example. Alternatively, the conductive antenna body 30' and/or the conductive antenna member 60' may be made from a wire structure, as illustrated in FIG. 2.

The wire structure for the conductive antenna member 60' may be formed by a cage construction or plurality of concentric loops 61' that become smaller in size from the periphery 66' to the center of the conductive antenna disk. A plurality of spaced-apart spokes 57' extend from the center to the periphery 66' of the conductive antenna disk 60' and intersect the plurality of concentric loops 61'. Other configurations would also be recognized by those skilled in the art.

Similarly, the wire structure for the conductive antenna body 30' may be formed by a plurality of concentric loops 53', 55' that become smaller in size from the medial portion 34' to the first and second opposing ends 32', 36' of the conductive antenna body 30'. A plurality of spaced-apart spokes 51', 55' extend from the first and second opposing ends 32', 36' to the medial portion 34' of the conductive antenna body 30 and intersect the plurality of concentric loops 53', 55'.

For the conductive antenna body 30, a first coaxial cable 70 having inner 72 and outer conductors 74 are coupled to respective ones of the first antenna feed points 40, 42. As readily appreciated by those skilled in the art, curling current on the rim 34 of the conductive antenna body 30 creates horizontal polarization. The first coaxial cable 70 may be fed along the slot 38 to the first antenna feed points 40, 42, as illustrated in the figures. Here, the outer conductor 74 may be further coupled along a portion of the slot 38 as well as to the first antenna feed point 40.

The conductive antenna body may also be configured to have multiple slots, with a respective first coaxial cable for each slot. An advantage of multiple slots/first coaxial cables connected in parallel is that the horizontal polarization radiation pattern is more uniformly circular. The routing of the coaxial cables 70, 80 is not critical to antenna function. For instance, the coaxial cables 70, 80 may run inside or outside the antenna 20. FIG. 1 routing is one non-limiting example. Furthermore, coaxial cable baluns have not been required.

For the conductive antenna member 60, a second coaxial cable 80 having inner 82 and outer conductors 84 is fed up though a center of the conductive antenna body 30. The inner conductor 82 is coupled to the second antenna feed point 62 on the conductive antenna member 60. The outer conductor 84 is coupled to the conductive antenna body 30, i.e., at least the second conical antenna element 54.

As readily appreciated by those skilled in the art, diverging current at a cone apex of the conductive antenna body 30 creates vertical polarization. Alternatively, the second coaxial cable 80 may be fed along the slot 38 instead of along the center of the conductive antenna member 60. The curl and divergence currents are everywhere mutually orthogonal so that dual polarization is possible for the illustrated antenna 20.

Figure 3:
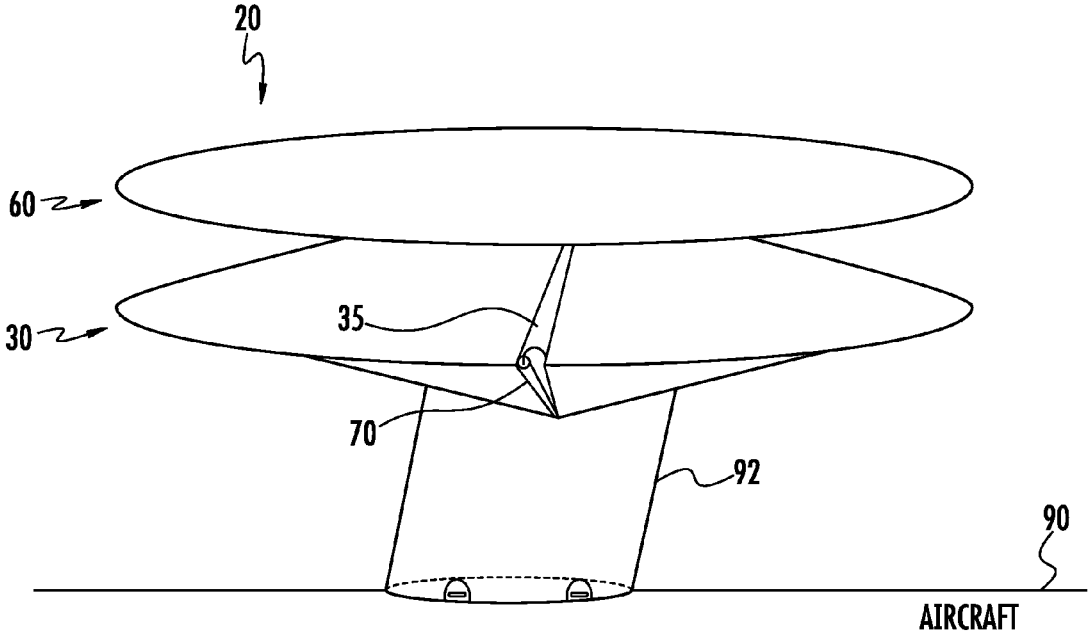
FIG. 3 is a side perspective view of the antenna illustrated in FIG. 1 mounted to an aircraft via an airfoil post.

The antenna 20 may be mounted to fixed or mobile platforms. When mounted to a mobile platform, such as an aircraft 90, for example, an airfoil post 92 may be used to support the conductive antenna body 30, as illustrated in FIG. 3. A radome, not shown, may also be used to enclose the antenna 20.

The conductive antenna member 60 may be configured as a folded conductive antenna member. An example of a folded conductive antenna member may be found in U.S. Pat. No. 7,864,127. This patent is assigned to the current assignee of the present invention, and is incorporated herein by reference in its entirety. The folded conductive antenna member may have a zero ohm termination resistor. Such a DC grounded folded conductive antenna member may be preferential for use on an aircraft to bleed static charges, for example.

The antenna 20 is not limited to any particular frequency of operation, as it can be linearly scaled. For instance, halving the antenna 20 size doubles antenna frequency, as readily understood by those skilled in the art. For illustration purposes, the antenna may be configured to operate at 2.44 GHz. At this frequency of operation, a diameter of the conductive antenna body 30 and the conductive antenna member 60 is about 2 inches, which corresponds to about 0.41 wavelengths ($0.41\lambda_{air}$). A thickness of the conductive antenna body 30 is about 0.5 inches, which corresponds to about 0.1 wavelengths ($0.10\lambda_{air}$). A thickness of the conductive antenna member 60 is about 0.10 inches, which corresponds to about 0.02 wavelengths ($0.21\lambda_{air}$). A thinner conductive antenna body 30 provides less wind resistance but less bandwidth. A thicker conductive antenna body 30 provides more wind resistance but more bandwidth.

Figure 4:
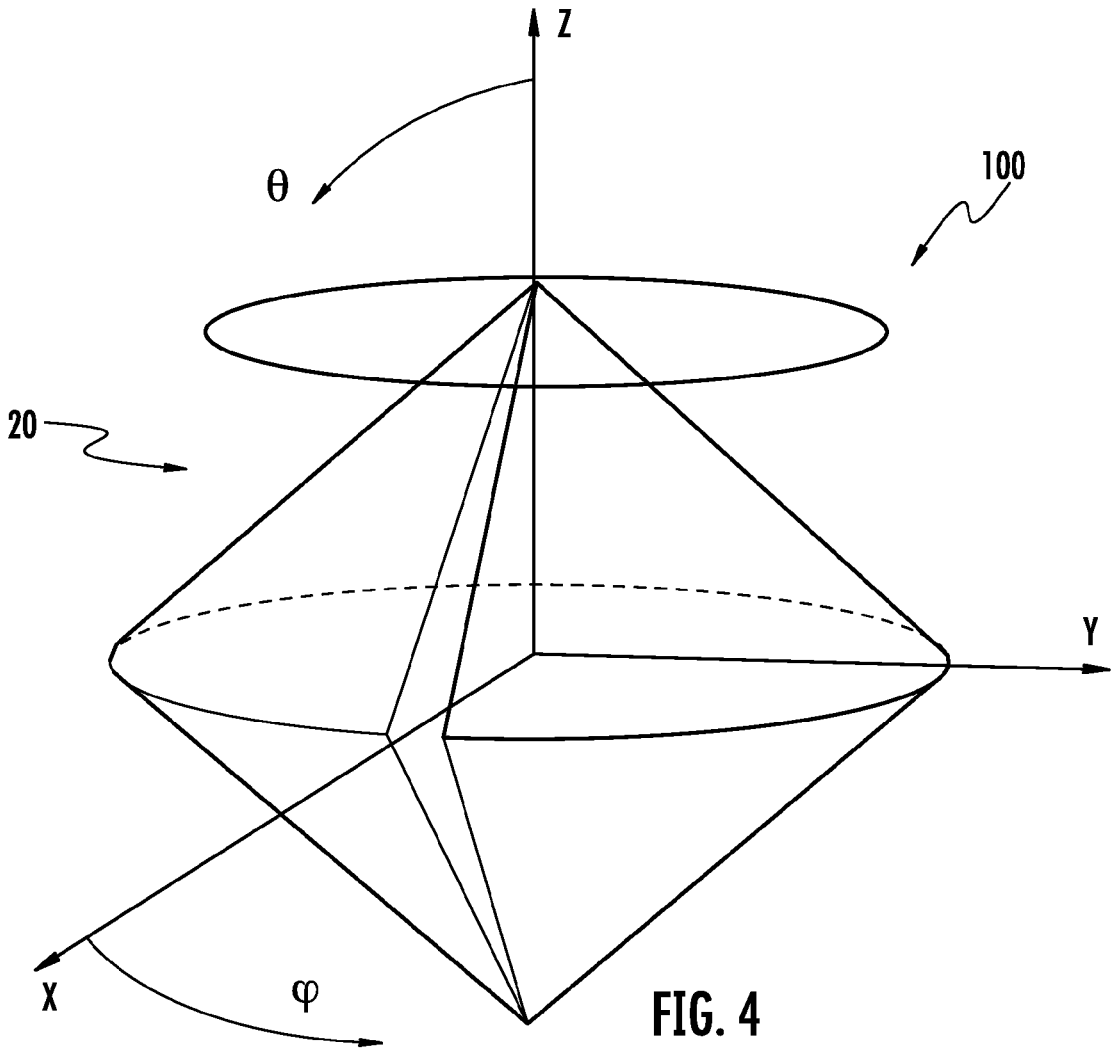
FIG. 4 is a side perspective view of antenna illustrated in FIG. 1 in the radiation pattern coordinate system.

The radiation pattern coordinate system 100 illustrated in FIG. 4 is used to define angles relative to the antenna 20. The different radiation patterns for the antenna 20 will now be discussed using the radiation pattern coordinate system 100.

Figure 5:
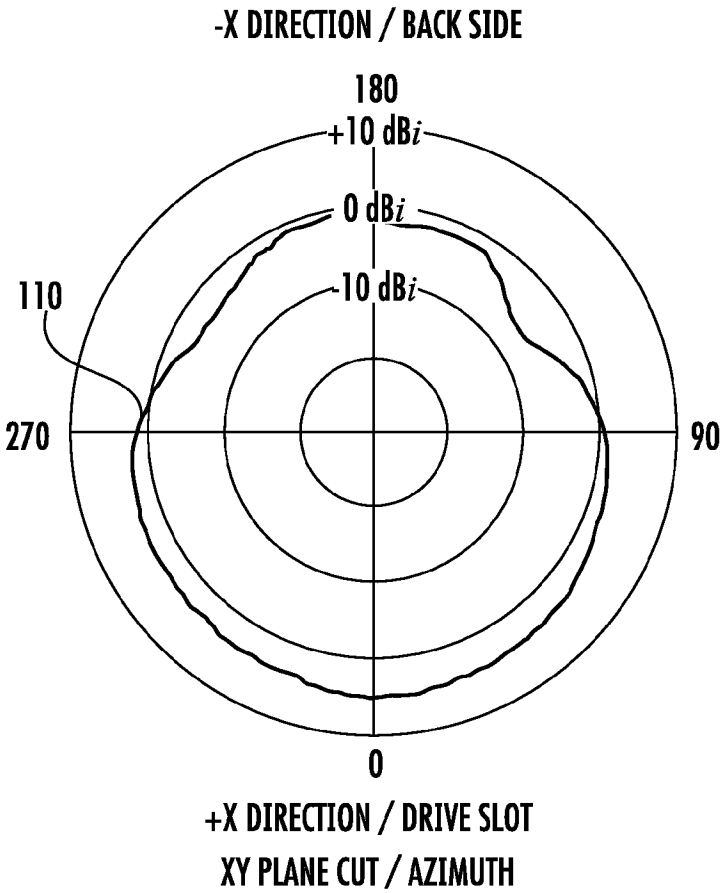

A measured horizontal polarization radiation pattern 110 at a first resonance, i.e., 2.44 GHz, in the XY plane cut/azimuth is provided in FIG. 5. Units are a realized gain in dBi or decibels with respect to an isotropic antenna. An anechoic chamber was used for the XZ plane cut/elevation. A horizontal polarization radiation pattern 120 is provided in FIG. 6. Measured horizontal polarization realized gain was about 2.0 dBi.

Figure 6:
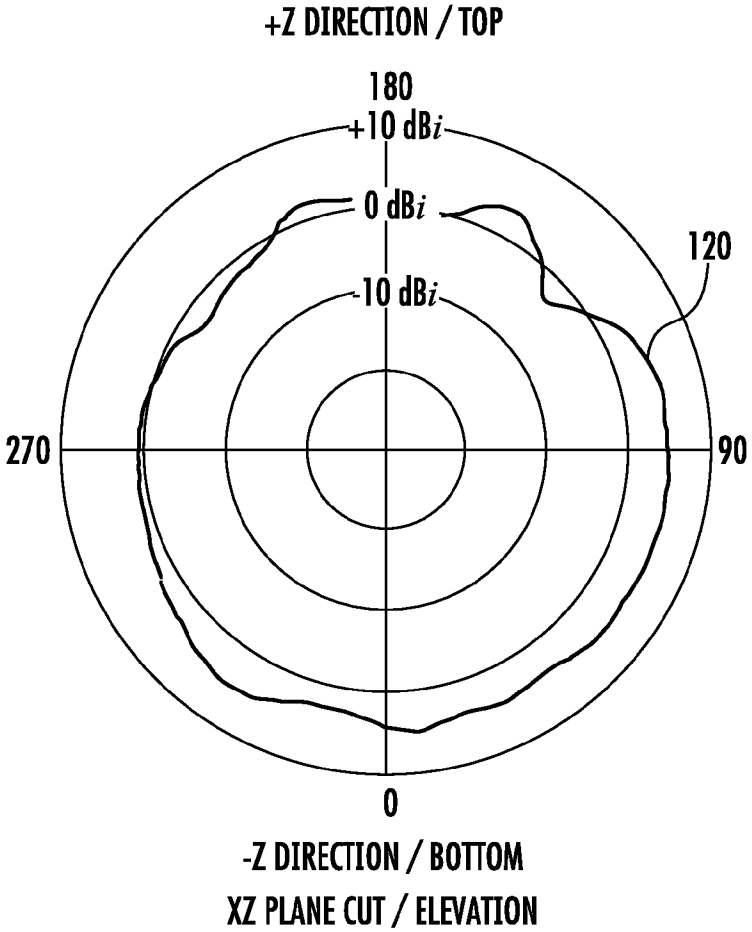
FIGS. 5 and 6 are respectively horizontal polarization radiation patterns in azimuth and elevation for the antenna illustrated in FIG. 1.

The FIG. 6 radiation pattern is for a single excitation slot 38. Smoother, more circular omni-directional radiation is provided by increasing the number of excitation slots 38. A finite element analysis was executed for a 4 slot 38 conductive antenna body 30. Each slot 38 was driven with equal amplitude and equal phase, and the azimuth cut radiation pattern was circular to within +/−1 dB. The elevation cut was nearly $\cos^2\theta$, which is similar to a two petal rose of the canonical half wave dipole.

Figure 8:
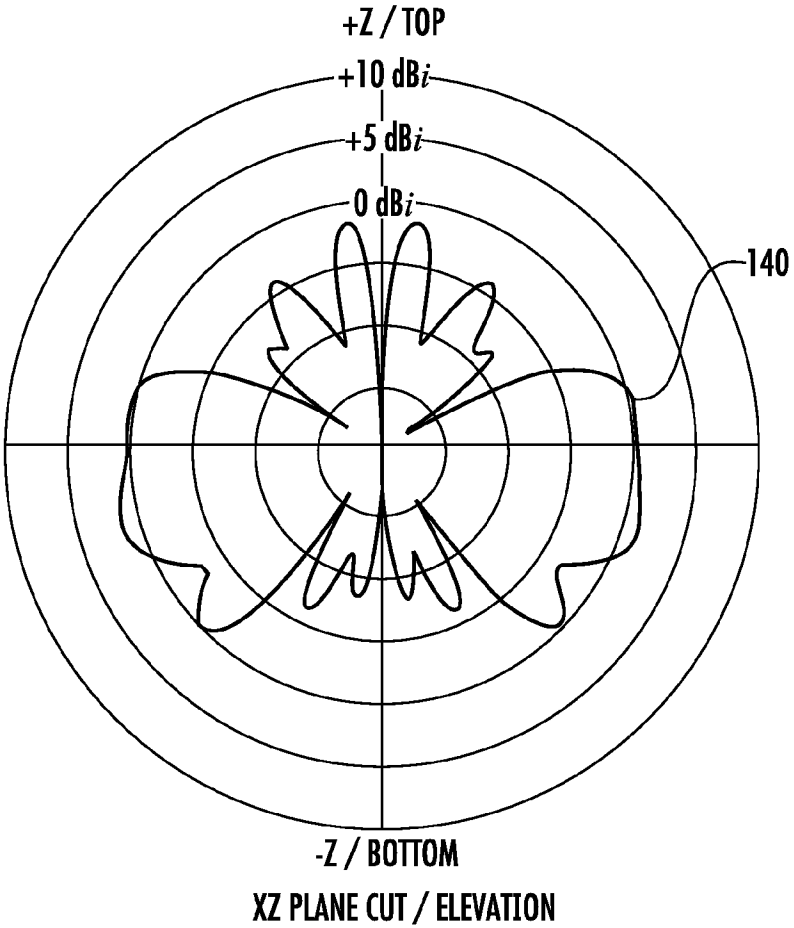
FIGS. 7 and 8 are respectively vertical polarization radiation patterns in azimuth and elevation for the antenna illustrated in FIG. 1.
Figure 7:
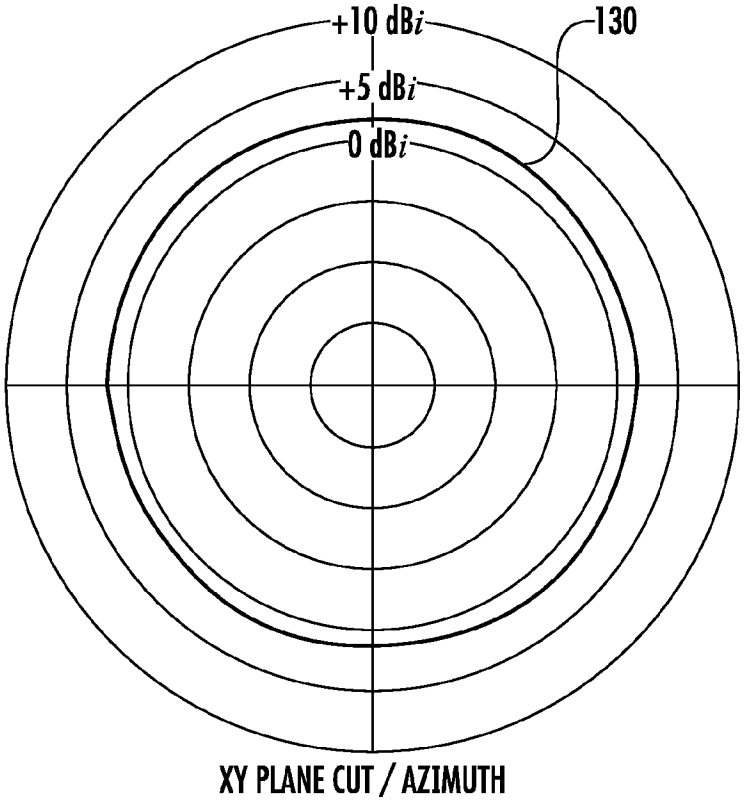

A vertical polarization radiation pattern 130 at the first resonance in the XY plane cut/azimuth is provided in FIG. 7. For the XZ plane cut/elevation, a vertical polarization radiation pattern 140 is provided in FIG. 8. Measured vertical polarization realized gain was about 2.0 dBi. There is a minor tendency for the vertical polarization radiation pattern lobe to walk downwards with rising frequency, an effect that is commonly known to discone antennas and conical monopoles. This may be attributed to a surface wave attaching to the cone and possibly ground plane diffraction effects.

Figure 9:
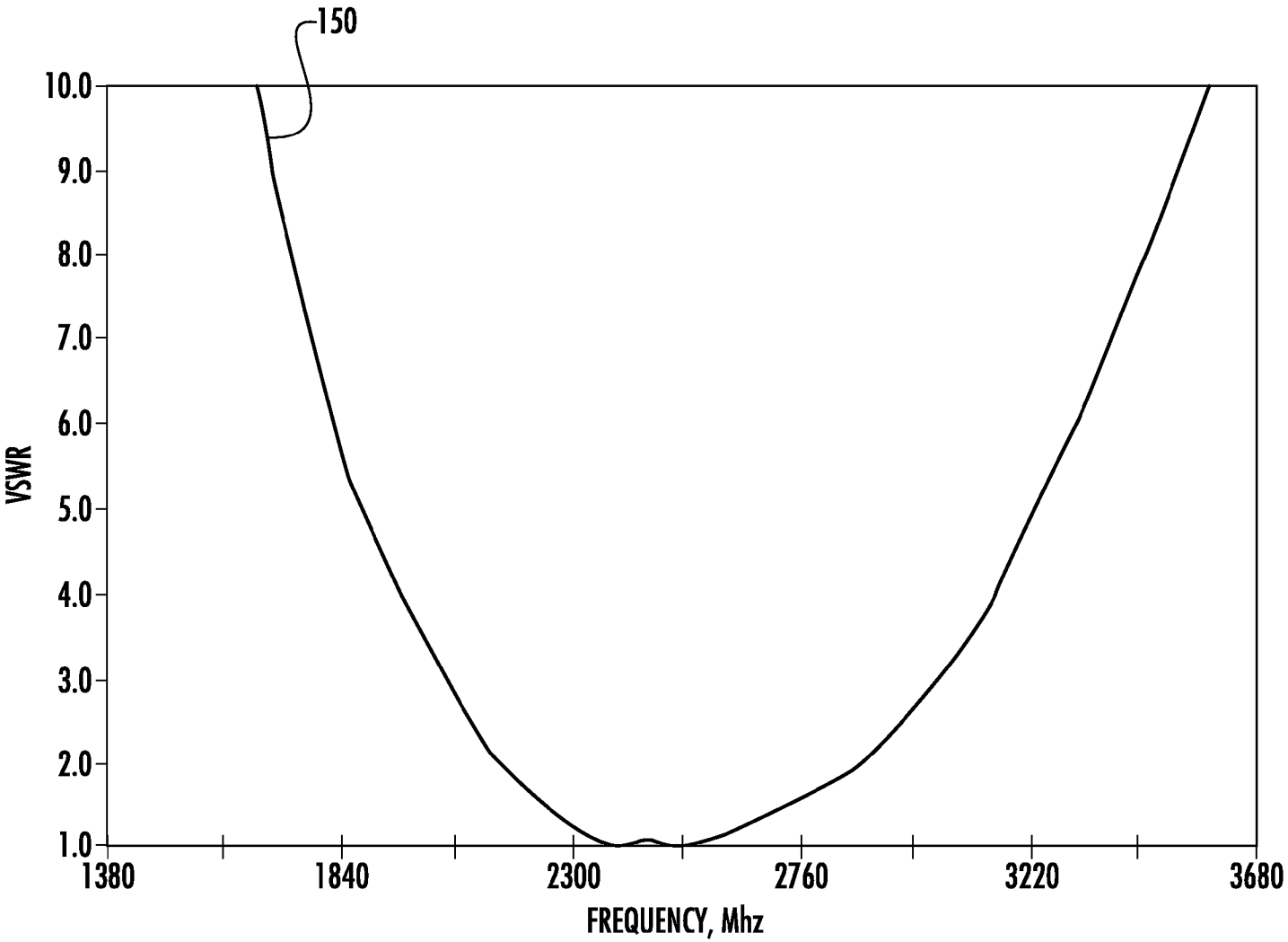
FIG. 9 is a graph illustrating VSWR for horizontal polarization for the antenna illustrated in FIG. 1.
Figure 10:
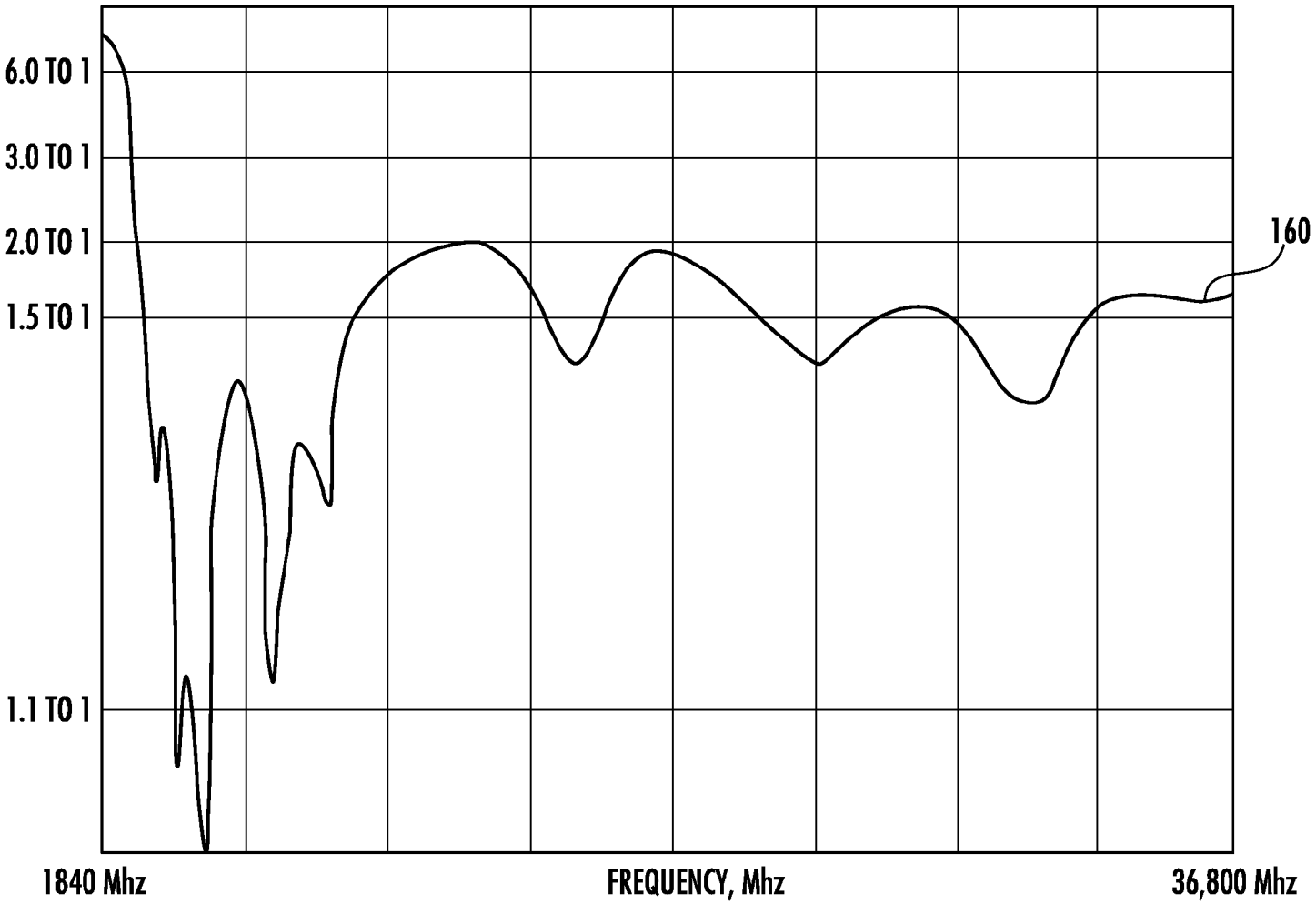
FIG. 10 is a graph illustrating VSWR for vertical polarization for the antenna illustrated in FIG. 1.

The VSWR (voltage standing wave ratio) for horizontal polarization is indicated by plot 150 on the graph illustrated in FIG. 9. The VSWR for vertical polarization is indicated by plot 160 on the graph illustrated in FIG. 10. A near perfect electrical load of 50 ohms is provided at 2.44 GHz. VSWR bandwidth for vertical polarization is greater than that for horizontal polarization because the conductive antenna body 30 and the conductive antenna member 60 together provide an expanding transmission line for the diverging and vertical polarization currents.

TABLE 1 provides a performance summary based on a prototype antenna.

TABLE 1

Performance Summary Of Antenna

| Parameter | Result | Basis |
|---|---|---|
| Antenna requirement | Aeronautical mobile, dual linear polarizations | Specified |
| Antenna type, vertical polarization | Dipole by divergence of electric current | Theory |
| Antenna type, horizontal polarization | Loop by curl of electric current | Theory |
| Diameter of the conductive antenna body 30 | 2 inches ($0.41\lambda_{air}$) | Measured and calculated |
| Thickness of the conductive antenna body 30 | 0.5 inches ($0.1\lambda_{air}$) | Measured and calculated |
| Thickness of the conductive antenna member 60 | 0.10 inches ($0.02\lambda_{air}$) | Measured and calculated |
| Frequency | 2441 Mhz | Calculated |
| Realized gain, horizontal polarization | +2.0 dBi | Measured |
| 3 dB realized gain bandwidth, horizontal polarization | 1470 Mhz | Measured |
| Realized Gain, Vertical Polarization | +2.0 dBi | Measured |
| 3 dB realized gain bandwidth, vertical polarization | Nearly high pass, >10,000 Mhz, >1000 percent | Measured |
| Radiation pattern | Omni-directional, both polarizations | Measured |
| Load impedance | 50 ohms nominal | Design criteria |
| VSWR, Horizontal Polarization at 2441 MHz | 1.2 to 2 | Measured |
| 2 to 1 VSWR Bandwidth, Horizontal Polarization at 2441 Mhz | 409 Mhz or 16 percent | Measured |
| VSWR, Vertical Polarization | 1.4 to 1 | Measured |
| 2 to 1 VSWR Bandwidth, Vertical Polarization | >10,000 Mhz, >1000 percent | Measured |

As background, while vertically polarized omni-directional antennas of great bandwidth are well known, horizontally polarized omni-directional antennas having similar bandwidth appear unknown. For instance, a prior art biconical dipole antenna, such as the one described in U.S. Pat. No. 2,175,252, which is an example of a vertically polarized omni-directional antenna, has a nearly high pass response with a bandwidth of 10 octaves or more. An example of a broadband horizontally polarized omni-directional antenna is the prior art Batwing Dipole Turnstile, as described in U.S. Pat. No. 2,510,290. Batwing dipole turnstile bandwidth is less than 1 octave, which is much less than that of the biconical dipole.

Figure 11:
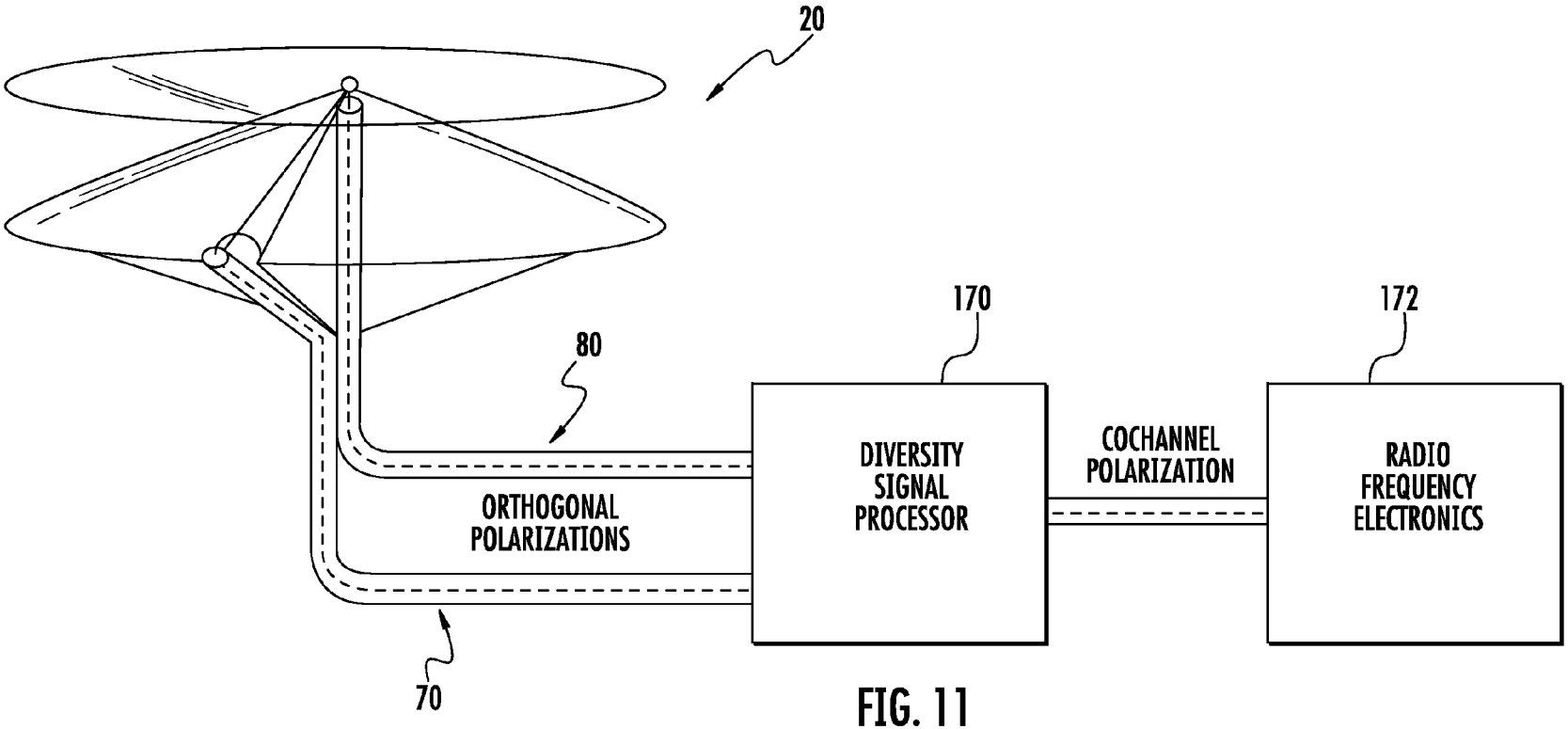
FIG. 11 is a block diagram of a communications system coupled to the antenna illustrated in FIG. 1.

The antenna 20 may be coupled to a communications system, wherein the communications system includes a diversity signal processor 170 and radio frequency (RF) electronics 172, as illustrated in FIG. 11. The diversity signal processor 170 selects or synthesizes copolarization or cross-polarization for the RF electronics 172. The diversity signal processor 170 may be as straightforward as a single pole double throw (SPDT) switch for selecting between vertical and horizontal polarization for best signal strength or lowest bit error rate, for example. The diversity signal processor 170 may also operate based on aircraft orientation when mounted on an aircraft 90.

More advanced embodiments of the diversity signal processor 170 may adjust amplitude and phase of the incoming orthogonal polarizations, and combine them to synthesize copolarization for the desired station and cross-polarization for the interference. Even though the function of the diversity signal processor 170 may be primarily directed toward selecting between dual linear polarizations, i.e., vertical and horizontal, slant linear and circular polarization may be synthesized from the orthogonal polarizations provided by the antenna 20 and the diversity signal processor 170. Adding 90 degrees of phase shift to the horizontal polarization and summing it with the vertical polarizations produces circular polarization, for instance.

Figure 12:
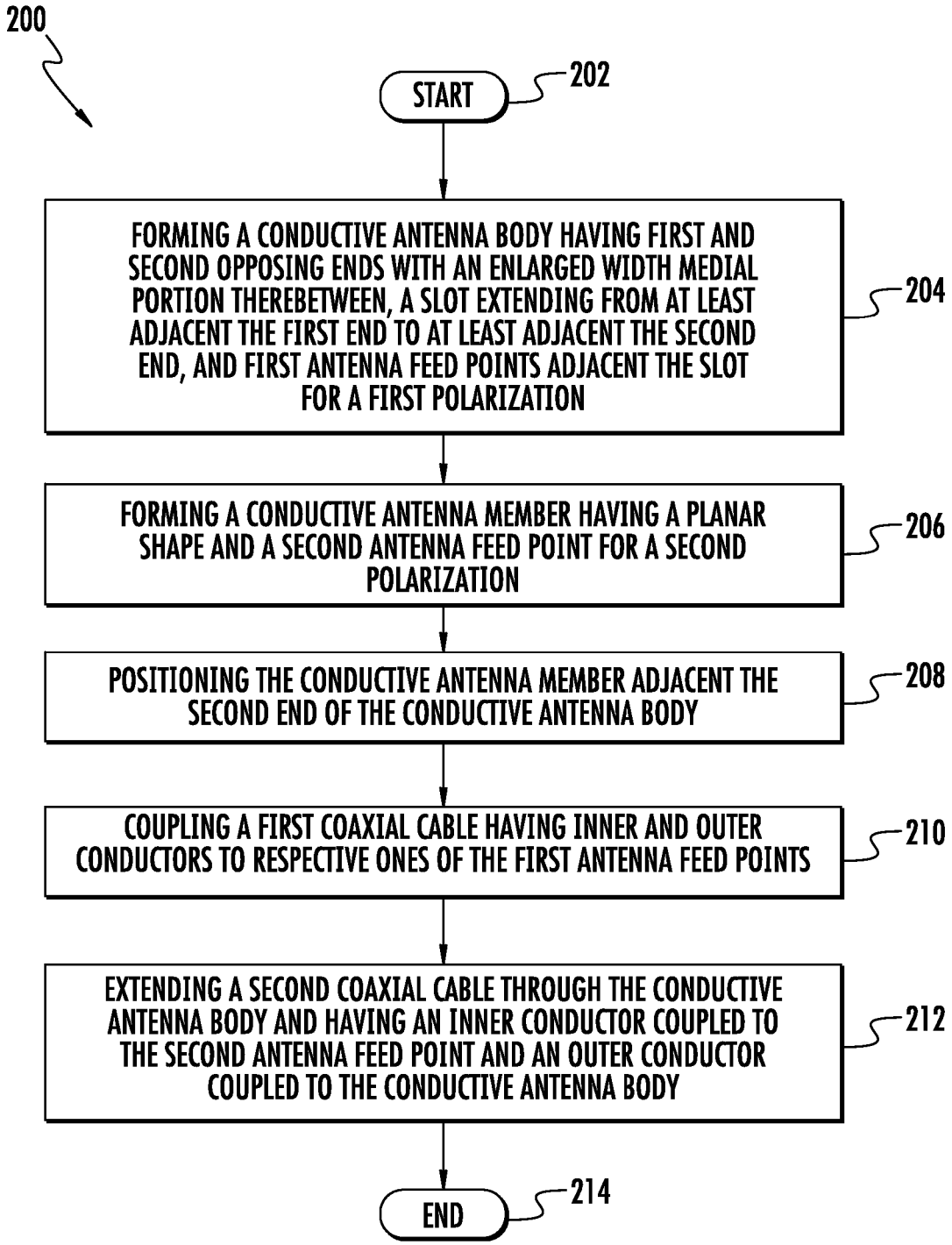
FIG. 12 is a flowchart illustrating a method for making the antenna illustrated in FIG. 1.

Referring now to the flowchart 200 in FIG. 12, another aspect is directed to a method for making an antenna 20 as described above. The method comprises, from the start (Block 202), forming a conductive antenna body 30 having first and second opposing ends 32, 36 with an enlarged width medial portion 34 therebetween at Block 204. A slot 38 extends from at least adjacent the first end 32 to at least adjacent the second end 36. First antenna feed points 40, 42 are adjacent the slot 34 for a first polarization.

A conductive antenna member 60 is formed at Block 206 and has a planar shape and a second antenna feed point 62 for a second polarization. The conductive antenna member 60 is positioned adjacent the second end 36 of the conductive antenna body 30 at Block 208. The method comprises at Block 210 coupling a first coaxial cable 70 having inner and outer conductors 72, 74 to respective ones of the first antenna feed points 40, 42. The method comprises at Block 212 coupling a second coaxial cable 80 extending through the conductive antenna body 30 and having an inner conductor 82 coupled to the second antenna feed point 62 and an outer conductor 84 coupled to the conductive antenna member 60. The method ends at Block 214.

While not being bound by a particular theory of operation, curling electric currents on the "flying saucer" like conductive antenna body 30 provides a horizontally polarized form of the loop antenna. Diverging (and alternately converging) electric currents between the conductive antenna body 30 and the conductive antenna member 60 provides a vertically polarized form of the dipole antenna. An infinite number of line shaped wire dipoles can be imagined to exist on the cone surface, and an infinite number of circular wire loop antennas can be imagined to exist on the cone surface as well. The current distributions on the antenna 20 surfaces are standing wave for both vertical and horizontal polarizations.

Antennas can exist in complimentary forms as panels, slots or skeleton slots according to Babinet's Principle and Booker's Relation. As the conductive antenna body 30 does not have hole in it, like a thin wire loop does, the conductive antenna body realizes the panel form of the loop antenna. The conductive antenna body 30 also implements a self exciting horn antenna, with the form of horn being one where fields are guided not by confinement, but by surface wave.

The one or more slots 38 provide impedance matching capability. For instance, the coaxial drive connections 40, 42 may be moved away from the medial portion 34 towards either of the first and second opposing ends 32, 36 to adjust antenna electrical load resistance. Driving the conductive antenna body 30 close to either the first and second opposing ends 32, 36 reduces resistance. Driving the conductive antenna body 30 close to medial portion 34 increases resistance. Moving the driving point along the slot 38 does not appreciably change the radiation pattern. A length of the slot 38 may be varied to adjust resonance frequency or for double tuning.

Figure 13:
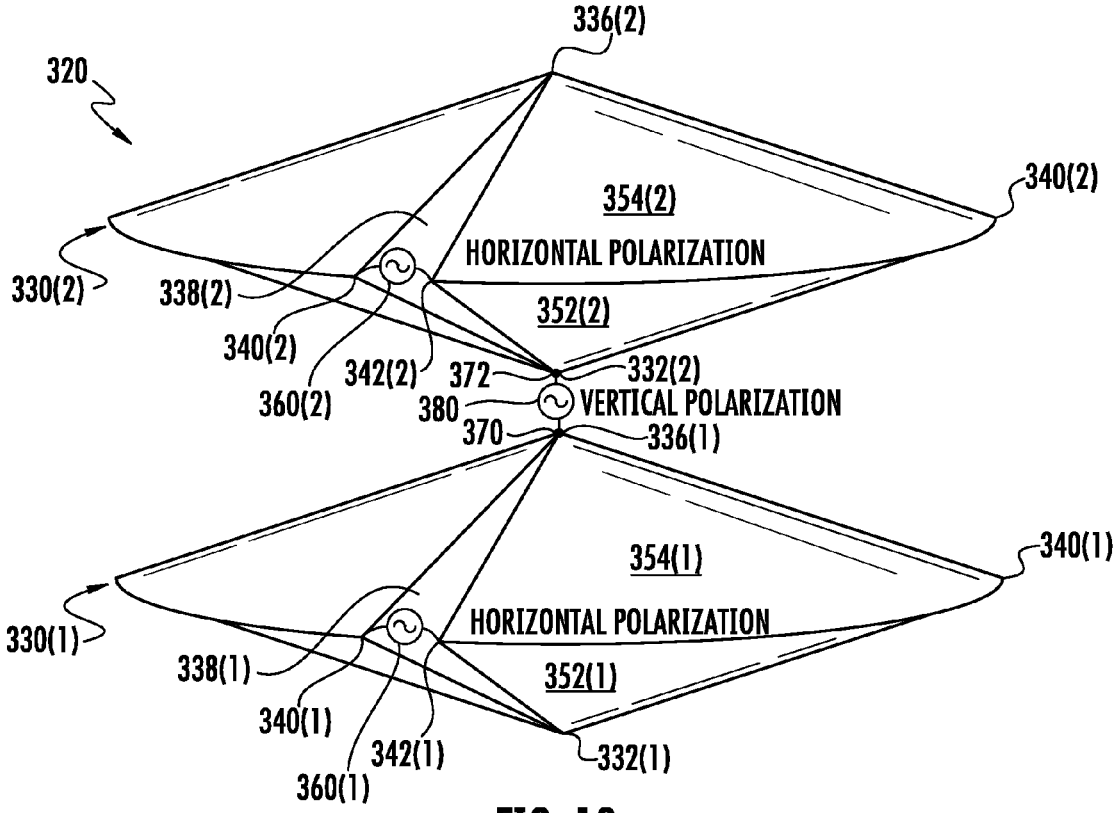
FIG. 13 is a side perspective view of another embodiment of the antenna illustrated in FIG. 1 with dual biconical conductive antenna bodies.

An additional embodiment of the antenna 320 will now be discussed in reference to FIG. 13, which is based on dual biconical conductive antenna bodies 330(1) and 330(2). This embodiment is advantageous for increased gain and for increased radiation pattern bandwidth while also providing horizontal and vertical polarization.

The antenna 320 includes a first conductive antenna body 320(1) having first and second opposing ends 332(1), 336(1) with an enlarged width medial portion 340(1) therebetween. A first slot 338(1) extends from at least adjacent the first end 332(1) to at least adjacent the second end 336(1). First antenna feed points 340(1), 340(2) are adjacent the first slot 338(1) for a first polarization.

Similarly, a second conductive antenna body 320(1) has first and second opposing ends 332(2), 336(2) with an enlarged width medial portion 340(2) therebetween. A second slot 338(2) extends from at least adjacent the first end 332(2) to at least adjacent the second end 336(2). Second antenna feed points 340(2), 342(2) are adjacent the second slot 338(2) for the first polarization. The first end 332(2) of the second conductive antenna body 330(2) is adjacent the second end 336(1) of the first conductive antenna body 330(1).

The antenna 320 further includes third antenna feed points 370, 372 between the first and second conductive antenna bodies 330(2), 330(2) for a second polarization. The first and second polarizations are orthogonal to one another. As discussed above, the first polarization may correspond to horizontal polarization and the second polarization may correspond to vertical polarization.

Excitation for the first polarization may be provided by RF sources 360(1), 360(2). The RF sources 360(1), 360(2) are preferentially equal in amplitude and equal in phase for providing a broadside, horizon radiation. The RF sources 360(1), 360(2) are connected by coaxial transmission lines as discussed above and which are not shown for clarity. Nonetheless, a first coaxial cable having inner and outer conductors would be coupled to respective ones of the first antenna feed points 340(1), 342(1) of the first conductive antenna body 330(1). A second coaxial cable having inner and outer conductors would be coupled to respective ones of the second antenna feed points 340(2), 342(2) of the second conductive antenna body 330(2).

Excitation for the second polarization may be provided by an RF source 380. This RF source 380 may be connected by a coaxial cable which is not shown for clarity. A third coaxial cable having inner and outer conductors may be coupled to respective ones of the third antenna feed points 370, 372. The vertical polarization pattern radiation pattern is very constant with frequency, e.g., the radiation pattern lobes stay on the horizon over a broad bandwidth. Dual linear polarizations may be provided by the antenna structure itself or by phase quadrature excitation (0, 90 degrees) at the RF sources 360(1), 360(2), 380 to synthesize circular polarization.

The first and second conductive antenna bodies 330(1), 330(2) each comprises first and second conical antenna elements 352(1), 354(1) and 352(2), 354(2) coupled together at the respective medial portion 340(1) and 340(2). The medial portion 340(1) of the first conductive antenna body 330(1) is aligned with the medial portion 340(2) of the second conductive antenna body 330(2).

Figure 14:
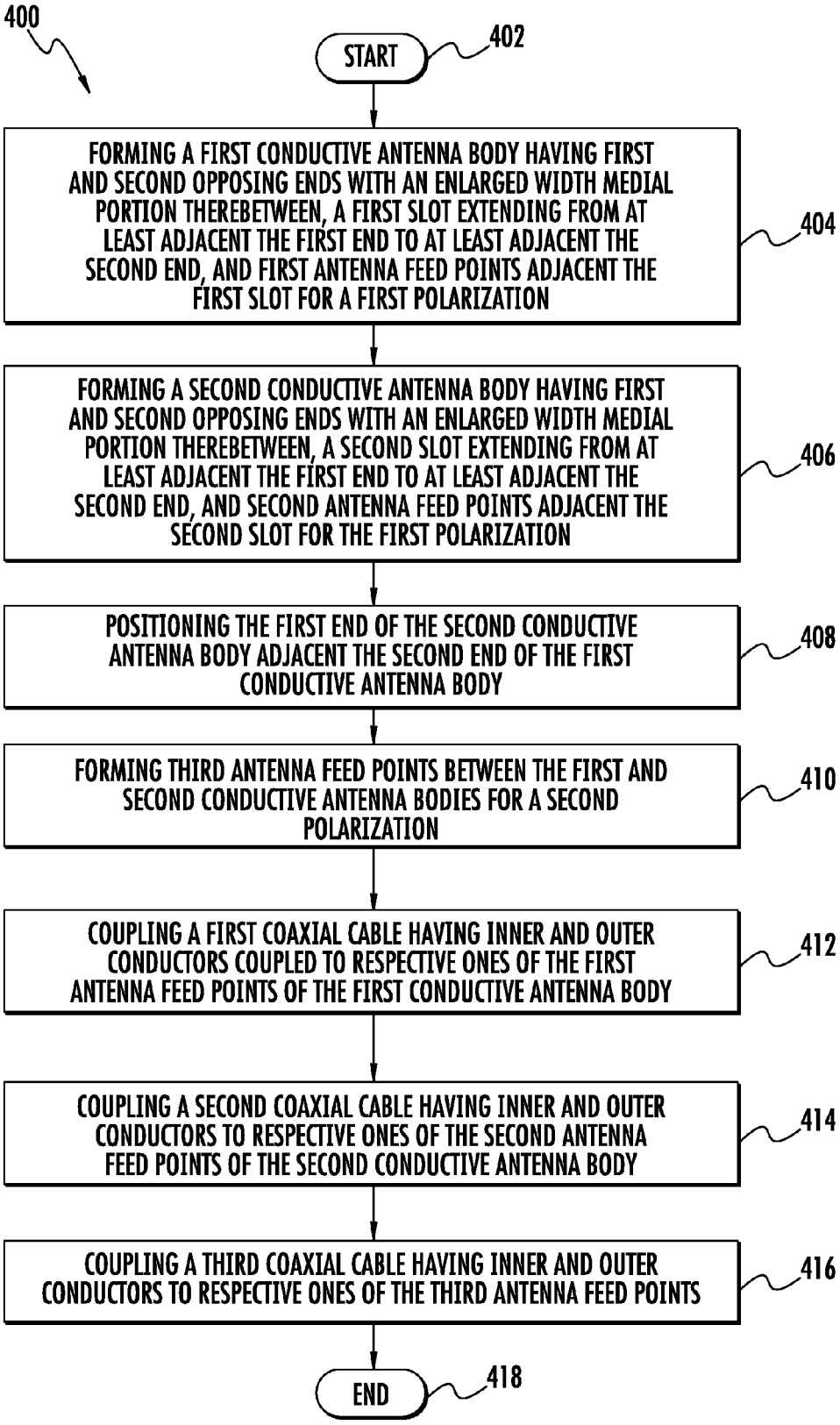
FIG. 14 is a flowchart illustrating a method for making the antenna illustrated in FIG. 13.

Referring now to the flowchart 400 in FIG. 14, another aspect is directed to a method for making an antenna 320 as described above. The method comprises, from the start (Block 402), forming a first conductive antenna body 330(1) having first and second opposing ends 332(1), 336(1) with an enlarged width medial portion 340(1) therebetween at Block 404. A first slot 338(1) extends from at least adjacent the first end 332(1) to at least adjacent the second end 336(1), and first antenna feed points 340(1), 340(2) are adjacent the first slot 338(1) for a first polarization.

A second conductive antenna body 330(2) is formed at Block 406 and has first and second opposing ends 332(2), 336(2) with an enlarged width medial portion 340(2) therebetween. A second slot 338(2) extends from at least adjacent the first end 332(2) to at least adjacent the second end 336(2), and second antenna feed points 340(2), 342(2) are adjacent the second slot 338(2) for the first polarization. The first end 332(2) of the second conductive antenna body 330(2) is positioned adjacent the second end 336(2) of the first conductive antenna body 330(1) at Block Third antenna feed points 370, 372 are formed between the first and second conductive antenna bodies 330(1), 330(2) for a second polarization at Block 410.

The method further includes coupling a first coaxial cable having inner and outer conductors coupled to respective ones of the first antenna feed points 340(1), 342(1) of the first conductive antenna body 330(1) at Block 412, coupling a second coaxial cable having inner and outer conductors to respective ones of the second antenna feed points 340(2), 342(2) of the second conductive antenna body 330(2) at Block 414, and coupling a third coaxial cable having inner and outer conductors to respective ones of the third antenna feed points 370, 372 at Block 416. The method ends at Block 418.

In view of the above discussions, other antenna embodiments are also practical, where multiple conductive antenna bodies and multiple conductive antenna members may be stacked and interposed, akin to a totem pole, as readily appreciated by those skilled in the art.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

This application is related to copending patent application entitled, "BROADBAND DUAL POLARIZATION OMNI-DIRECTIONAL ANTENNA WITH DUAL CONDUCTIVE ANTENNA BODIES AND ASSOCIATED METHODS," Ser. No. 13/963,182 which is filed on the same date and by the same assignee and inventors, the disclosures which are hereby incorporated by reference.

That which is claimed is:

1. An antenna comprising:

a conductive antenna body having first and second opposing ends with an enlarged width medial portion therebetween, a slot extending from at least adjacent the first end, through the medial portion, and to at least adjacent the second end, and first antenna feed points adjacent the slot for a first polarization;

a conductive antenna member adjacent the second end of said conductive antenna body and having a planar shape and a second antenna feed point for a second polarization, with the planar shape of said conductive antenna member being normal to an axis extending through the first and second opposing ends of said conductive antenna body;

said conductive antenna body comprising first and second conical antenna elements coupled together at the enlarged width medial portion;

a first coaxial cable extending through the slot from the first end of said first conical antenna element, and having inner and outer conductors coupled to respective ones of said first antenna feed points;

a second coaxial cable extending through said first and second conical antenna elements, and having an inner conductor coupled to said conductive antenna member and an outer conductor coupled to said second conical antenna element; and said conductive antenna body and said conductive antenna member configured to provide omni-directional coverage.

2. The antenna according to claim 1 wherein said conductive antenna body comprises first and second conical antenna elements coupled together at the medial portion.

3. The antenna according to claim 1 wherein said conductive antenna member comprises a conductive antenna disk.

4. The antenna according to claim 1 wherein the enlarged width medial portion of said conductive antenna body is aligned with a periphery of said conductive antenna member.

5. The antenna according to claim 1 wherein said conductive antenna body comprises a continuous conductive layer.

6. The antenna according to claim 1 wherein said conductive antenna body comprises a wire structure.

7. The antenna according to claim 1 wherein said conductive antenna member comprises a continuous conductive layer.

8. The antenna according to claim 1 wherein said conductive antenna member comprises a wire structure.

9. The antenna according to claim 1 further comprising an airfoil post supporting said conductive antenna body.

10. The antenna according to claim 1 wherein the first and second polarizations are orthogonal to one another.

11. An antenna comprising:

a conductive antenna body comprising first and second conical antenna elements arranged to define first and second opposing ends with an enlarged width medial portion therebetween, a slot extending from at least adjacent the first end, through the medial portion, and to at least adjacent the second end, and first antenna feed points adjacent the slot for a first polarization;

a conductive antenna disk adjacent the second end of said conductive antenna body and having a second antenna feed point for a second polarization orthogonal to said first polarization, with a planar shape of said conductive antenna disk being normal to an axis extending through the first and second opposing ends of said conductive antenna body;

said conductive antenna body comprising first and second conical antenna elements coupled together at the enlarged width medial portion;

a first coaxial cable extending through the slot from the first end of said first conical antenna element, and having inner and outer conductors coupled to respective ones of said first antenna feed points;

a second coaxial cable extending through said first and second conical antenna elements and having an inner conductor coupled to said conductive antenna disk and an outer conductor coupled to said second conical antenna element; and said conductive antenna body and said conductive antenna member configured to provide omni-directional coverage.

12. The antenna according to claim 11 wherein the medial portion of said conductive antenna body is aligned with a periphery of said conductive antenna disk.

13. The antenna according to claim 11 wherein said conductive antenna body comprises a first continuous conductive layer; and wherein said conductive antenna disk comprises a second continuous conductive layer.

14. The antenna according to claim 11 wherein said conductive antenna body comprises a first wire structure; and wherein said conductive antenna disk comprises a second wire structure.

15. A method for making an antenna comprising:

forming a conductive antenna body having first and second opposing ends with an enlarged width medial portion therebetween, a slot extending from at least adjacent the first end, through the medial portion, and to at least adjacent the second end, and first antenna feed points adjacent the slot for a first polarization;

positioning a conductive antenna member adjacent the second end of the conductive antenna body and having a planar shape and a second antenna feed point for a second polarization, with the planar shape of said conductive antenna disk being normal to an axis extending through the first and second opposing ends of said conductive antenna body;

the conductive antenna body comprising first and second conical antenna elements coupled together at the enlarged width medial portion;

extending a first coaxial cable through the slot from the first end of the first conical antenna element, and having inner and outer conductors coupled to respective ones of the first antenna feed points;

extending a second coaxial cable extending through the first and second conical antenna elements, and having an inner conductor coupled to the conductive antenna member and an outer conductor coupled to the second conical antenna element; and the conductive antenna body and the conductive antenna member configured to provide omni-directional coverage.

16. The method according to claim 15 wherein the conductive antenna body comprises first and second conical antenna elements coupled together at the medial portion.

17. The method according to claim 15 wherein the conductive antenna member comprises a conductive antenna disk.

18. The method according to claim 15 wherein the enlarged width medial portion of the conductive antenna body is aligned with a periphery of the conductive antenna member.

19. The method according to claim 15 wherein the conductive antenna body comprises a first continuous conductive layer; and wherein the conductive antenna disk comprises a second continuous conductive layer.

20. The method according to claim 15 wherein the conductive antenna body comprises a first wire structure; and wherein the conductive antenna disk comprises a second wire structure.

21. The method according to claim 15 wherein the first and second polarizations are orthogonal to one another.

* * * * *